US005456620A

United States Patent [19]

Kaminski

[11] Patent Number: 5,456,620

[45] Date of Patent: Oct. 10, 1995

[54] CONNECTOR ASSEMBLY FOR LAMPS

[75] Inventor: Les K. Kaminski, Shelby Township, Mich.

[73] Assignee: Chrysler Corporation, Highland Park, Mich.

[21] Appl. No.: 364,502

[22] Filed: Dec. 27, 1994

Related U.S. Application Data

[63] Continuation of Ser. No. 90,525, Jul. 13, 1993, abandoned.

[51] Int. Cl.[6] ..... H01R 25/00

[52] U.S. Cl. ..... 439/654; 439/619

[58] Field of Search ..... 439/638–655, 439/619, 699, 617, 611

[56] References Cited

U.S. PATENT DOCUMENTS

| | | | |
|---|---|---|---|
| 2,448,452 | 8/1948 | Morelock | 439/651 |
| 3,740,546 | 6/1973 | Boysen et al. | 439/56 |
| 5,035,643 | 7/1911 | Forish et al. | 437/699 |
| 5,286,223 | 2/1994 | Ogawa | 439/619 |

*Primary Examiner*—David L. Pirlot
*Attorney, Agent, or Firm*—Christopher Taravella

[57] ABSTRACT

A connector assembly for lamps such as lamps which are used for automotive signaling lamps includes a single adaptor plug which, at a first end, plugs into a socket fixed to the signal light assembly and at a second end has a socket for receiving a flat sealed end of a bulb. The adaptor plug includes a pair of electrical contacts therein each of which has a female electrical connector at both ends. One end of each female electrical connector receives a blade of a wire lead contact while the other end receives the flattened, sealed end of the bulb and makes contact with one of the bulb terminals. The adaptor includes a lug projecting from a surface thereof which lug is received in a recess in a spring arm latch mounted on the socket. By utilizing the aforedescribed adaptor plug, a simpler, more reliable, less expensive connector assembly for automotive lamps is provided.

13 Claims, 2 Drawing Sheets

CONNECTOR ASSEMBLY FOR LAMPS

This application is a continuation of application Ser. No. 08/090,525, filed Jul. 13, 1993, now abandoned.

FIELD OF THE INVENTION

The present invention relates to connector assemblies for lamps. More particularly, the present invention relates to connector assemblies for lamps, wherein an adaptor is used for mounting and connecting a particular bulb in a socket, which socket is not configured to receive the bulb directly.

BACKGROUND ART

Automobiles utilize a large number of bulbs as indicators for signaling and other purposes. For both tail lights and front lights, especially tail and front signaling lights, 12 volt bulbs of a generally standard configuration are utilized, wherein the bulbs have sealed end portions with relatively fragile projecting leads. These bulbs fit into specially configured bulb sockets which are connected by pigtails to adaptor plugs. The adaptor plugs are then received in sockets which are fixed to the structure of the signal light. Since additional connections necessarily provide locations where current may be interrupted, the additional electrical connections have at least the slight possibility of compromising reliability. Moreover, the additional electrical connections and associated components increase significantly the expense of the signal lights.

In view of these characteristics of a currently used approach, there is a need for a less expensive and probably more reliable configuration for mounting standardized electric bulbs. This is especially the case in the automobile and trucking industry where millions of vehicles are produced, each of which may utilize at least 8 to 12, and perhaps more, front and rear signal lights.

SUMMARY OF THE INVENTION

It is a feature of the present invention to provide a new and improved connector assembly for lamps, such as automotive signaling lamps, wherein the connector assembly is configured to minimize both expense and complexity.

In view of this feature and other features, the instant invention contemplates a connector assembly for lamps, wherein the connector assembly includes a bulb base which is configured as a slidable adaptor plug that is received in a fixed socket having power leads mounted therein. The adaptor socket has a pair of electrical contacts therein, each of which has first and second female ends defined by spring arms. One spring arm receives the flattened, sealed end portion of the bulb and electrically connects with the bulb terminals while the other female end receives a blade extending from one end of a contact having a connector for power leads at the other end.

In order to detachably fix the adaptor plug within the socket, there is a releasable latch engaging a lug projecting from the adaptor plug.

Additional features of the adaptor plug include a rectangular insert portion which is received within a rectangular recess defining the socket and a pair of stops on the adaptor plug which abut a front wall of the socket to limit depth of insertion of the adaptor plug.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
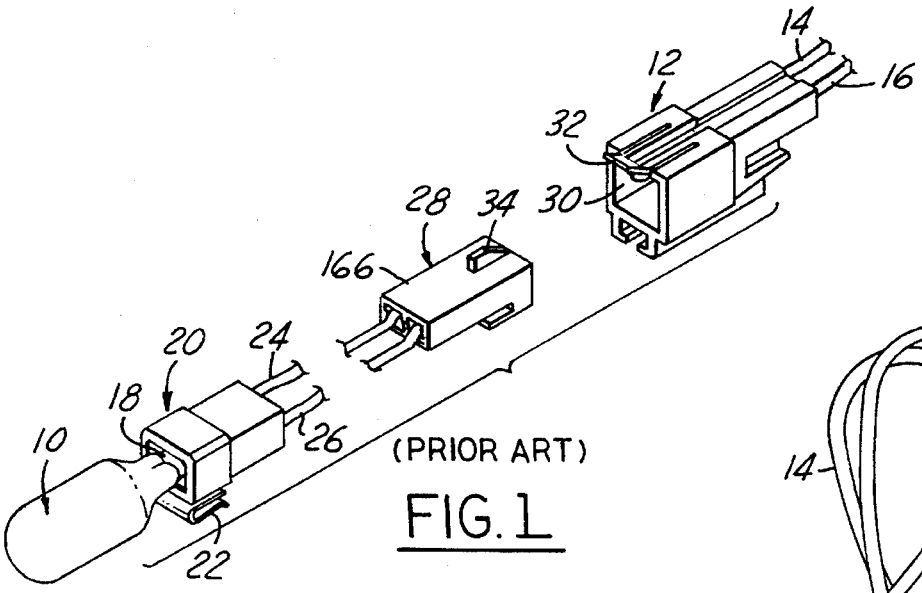
(PRIOR ART) FIG. 1
FIG. 1 is a perspective view of a prior art arrangement for mounting bulbs in the sockets of signal lights.

Prior Art Configurations (FIG. 1)

Referring now to FIG. 1, there is shown a prior art approach for mounting a bulb 10 used in an automotive signal light, or the like, in a socket 12 fixed to a signal light structure. The socket 12 has an insulating body of molded resinous material and is connected by a pair of leads 14 and 16 to a 12 volt power supply (not shown). In accordance with prior art practices, the bulb 10 has a flattened end portion 18 which is received in a bulb base 20 of molded resinous material. The bulb base 20 has a clip 22 thereon for securing the bulb base to the signal light structure. A pair of pigtail leads 24 and 26 connect the bulb base 20 to an adaptor 28 of molded resinous material which is received within a complementary cavity 30 in the socket 12. The adaptor 28 is locked in place by a latch 32 on the socket 12 which engages a lug 34 on the adaptor.

Improved Configuration (FIGS. 2–6)

Referring now to the embodiment of FIG. 2–6, wherein the structure of the present invention is shown, it is seen that the bulb base 20 and the pigtails 24 and 26 of FIG. 1 are no longer utilized. Moreover, the adaptor 28 of FIG. 1 is no longer employed, rather an adaptor plug 40 of FIG. 2 having an insulating body portion 41 of molded resinous material is utilized which by itself performs all the necessary functions of the bulb base 20, pigtails 24 and 26 and adaptor 28 of the FIG. 1, prior art embodiment. As will be further explained hereinafter, the arrangement of FIGS. 2–6 has deleted a number of components, while retaining the functions of those components by plugging a first end of the plug adaptor 40 directly into the socket 12 and plugging the bulb 10 directly into a second end of the plug adaptor.

Figure 4:
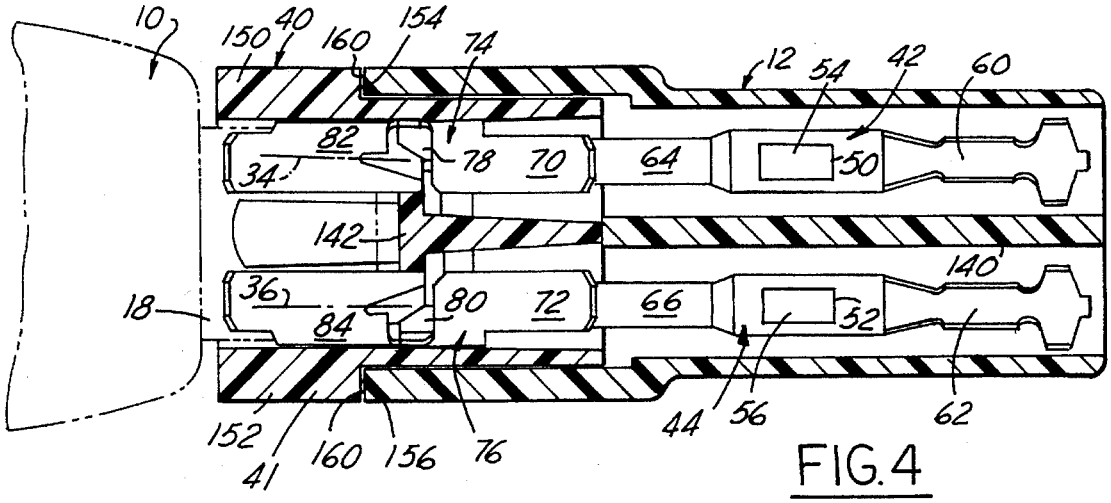
FIG. 4 is a top elevational view of the assembly of FIG. 3 with the light bulb shown in phantom.
Figure 5:
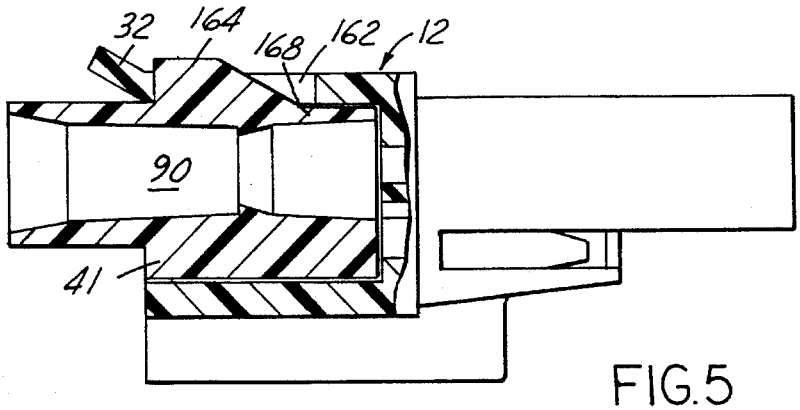
FIG. 5 is a side view of the molded portions of the connector assembly without contacts therein.
Figure 6:
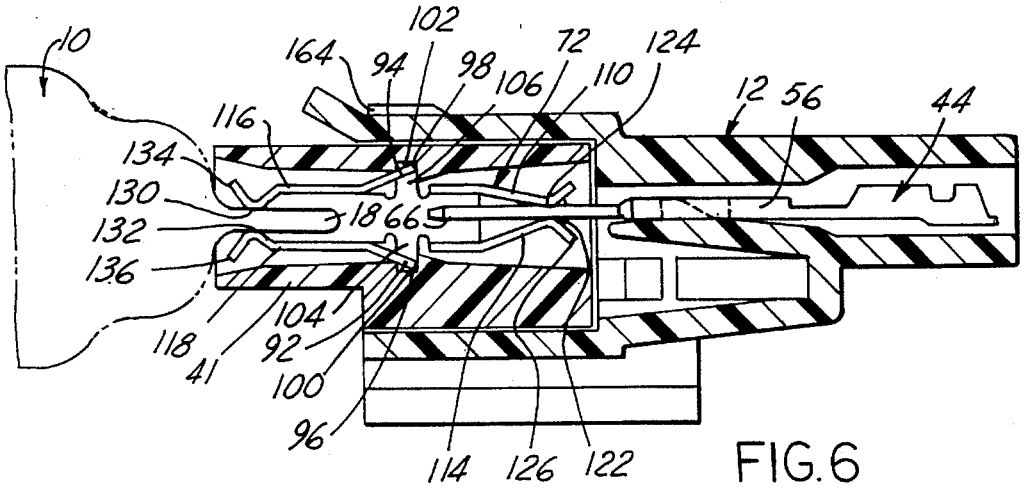
FIG. 6 is a side elevational view taken along lines 6—6 of FIG. 4.

Socket 12 of FIG. 2–6 is identical to the socket 12 of FIG. 1, as are the leads 14 and 16 extending from the sockets 12. Moreover, the lamp 10 is the same lamp used in FIG. 1. In FIGS. 4 and 6, there are shown a pair of identical unitary contacts 42 and 44 mounted within the socket 12. The unitary contacts 42 and 44 are identical to unitary contacts used in the socket 12 of the prior art configuration of FIG. 1. The contacts 42 and 44 have center portions 46 and 48, respectively, that have recesses 50 and 52, respectively. The recesses 50 and 52 receive lugs 54 and 56, respectively, which retain the contacts 42 and 44 in place. Crimp portions 60 and 62 for crimping the leads 14 and 16 (FIGS. 2 and 3) extend from the first end of the center portions 42 and 44 while blades 64 and 66 extend from second ends of the center portions.

Figure 2:
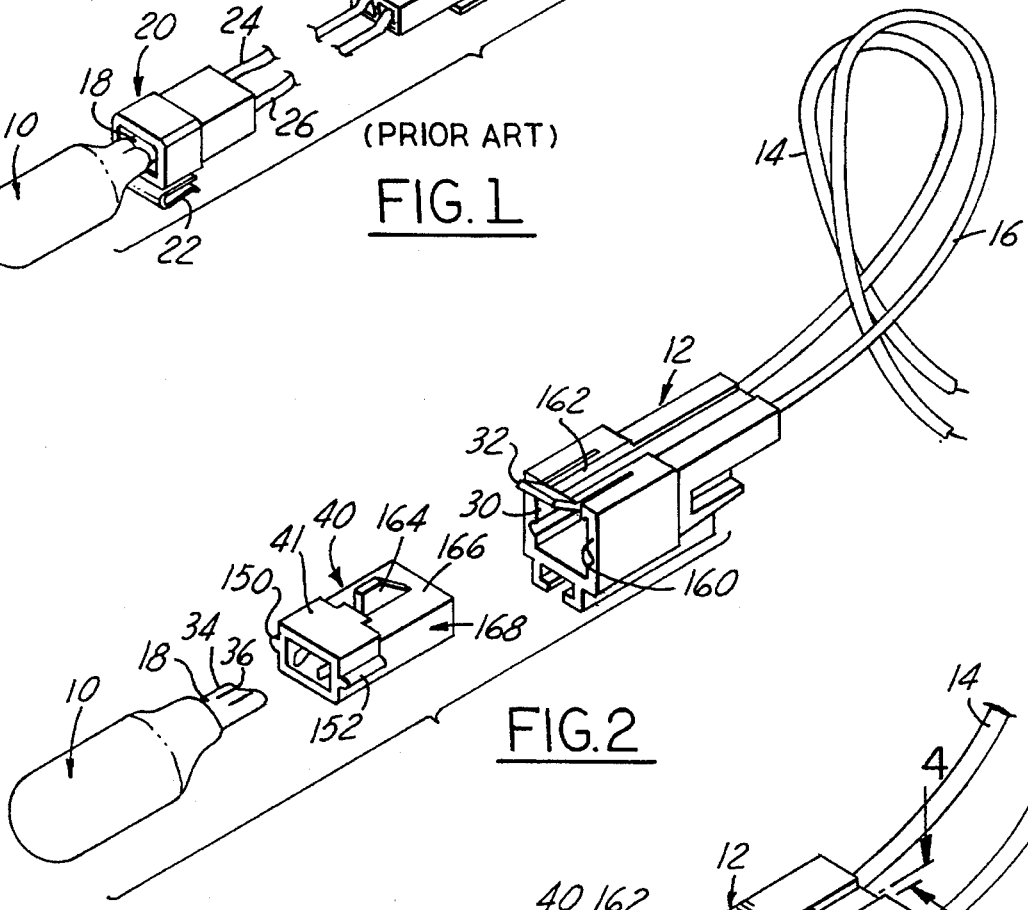
FIG. 2 is an exploded view, in perspective, of the connector assembly of the instant invention.
Figure 3:
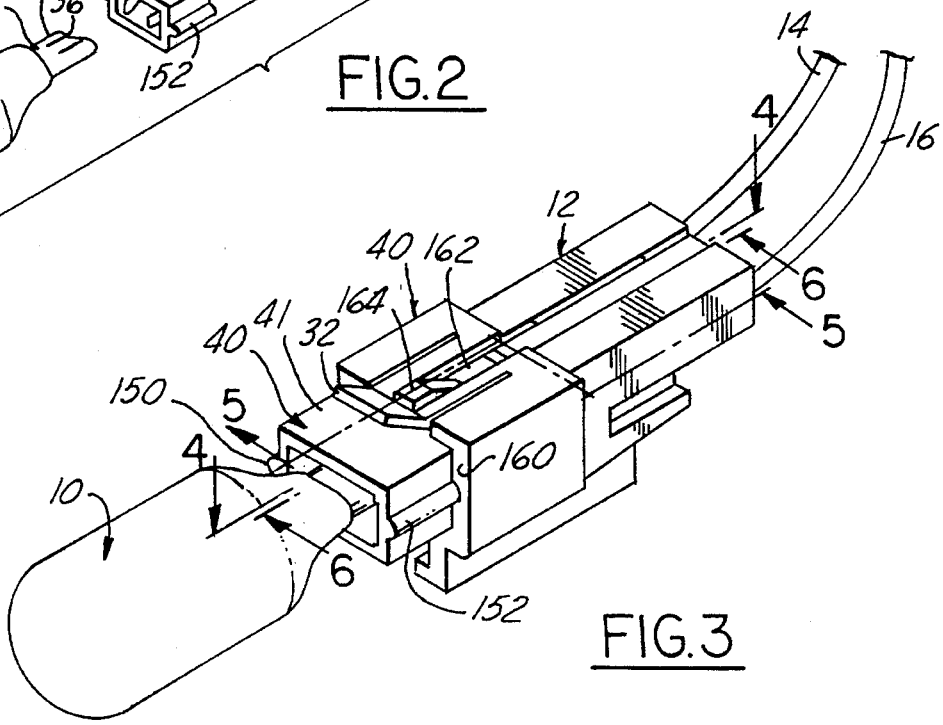
FIG. 3 is an enlarged view of the connector assembly of FIG. 2 showing a bulb, adaptor plug and socket in the assembled mode.

As will be explained further hereinafter, the blades 64 and 66 in the socket 12 form male contacts which mate with female connectors 70 and 72 forming first ends of adaptor contacts 74 and 76 in the new adaptor plug 40. Extending in a second direction from middle portions 78 and 80 of the female connections 74 and 76 are second female connectors 82 and 84 which receive the flattened, sealed end portion 18 of a bulb 10. As is seen in FIGS. 2, 4 and 6, flattened sealed portion 18 of the bulb 10 has the fragile bulb terminals 34 and 36 which are engaged by the second pair of female connectors 82 and 84.

The adapted contacts 74 and 76 are each formed of a single piece of metal and are retained within an interior space 90 of the adaptor 40 by a pair of flared tangs 92 and 94 which abut a pair of shoulders 96 and 98 extending into the space 90. Disposed adjacent the shoulders 98 are recesses 100 and 102 which cooperate with additional tangs 104 and 106 to keep the adaptor contacts 74 and 76 in place.

As is seen in FIG. 6, each of the adaptor contacts 70–72 and 82–84 have first and second female connectors which are comprised of opposed spring arm pairs 110–114 and 116–118, respectively. The spring arm pairs 110–114 and 116–118 forming the female connectors 72 and 84 are formed in an identical fashion in the adaptor contact 74 and in the adaptor contact 76. The spring arms 110 and 114 have contact areas 120 and 122, respectively, and flare at ends 124 and 126 so as to provide an opening which spreads to accommodate the blade 66 of contact 44 of the socket 12. The spring arms 116 and 118 each have contact areas 130 and 132 and flared ends 134 and 136 spread to receive the flattened end portion 18 of the bulb 10.

In order to ensure electrical isolation, a wall 140 separates the contacts 42 and 44 in the socket 12 while a wall 142 separates the first female connectors 70 and 72 in the adaptor plug 40 (see FIG. 4).

In order to limit its depth of insertion into the socket 12, the adaptor plug 40 has a pair of ribs 150 and 152 which have ends 154 and 156 that abut the front wall surfaces 160 of the socket.

The spring latch arm 32 which is molded unitary with the socket 12 has a recess 162 therein which receives a lug 164 extending from the top surface 166 of an insert portion 168 at the first end of adaptor plug 40 (see FIG. 2). The insert portion 166 has a rectangular cross-section which complements the rectangular opening of the cavity 30 in the socket 12. The adaptor plug 40 is therefore rotationally stabilized with respect to the socket 12. The female contacts 70 and 72 within the adaptor plug 40 therefore slide smoothly into registration with the blades 64 and 66 of the contacts 42 and 44 mounted in the socket 12.

From a comparison of the connector assembly of FIGS. 2–6 with the connector assembly of FIG. 1, it is apparent that the connector assembly of FIGS. 2–6 have similar components but fewer connections than the prior art connector assembly of FIG. 1. In addition, the connector assembly of FIGS. 2–6 allows the socket 12 to support the bulb 10 without additional structures such as the clip 22 which is utilized with the bulb base 20 of FIG. 1.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A connector assembly for a lamp comprising:

a bulb, the bulb having a flattened sealed end portion with two bulb terminals disposed over the flattened sealed end portion;

a socket for energizing the bulb, the socket having a cavity with two electrical contacts extending parallel with one another in an axial direction therein, each of the contacts having first and second ends, the first ends of the contacts being connected to power leads and the second ends of the contacts being male electrical connectors;

an adaptor plug having first and second ends and two contacts disposed completely therein wherein the contacts each have first and second ends and extend in a direction parallel to the axial direction when the plug is mounted in the socket; the first end of the adaptor being slidably receivable in the socket and the first ends of each of the contacts each having first female connectors for receiving the male connectors within the socket, the second ends of the contacts each having second female connectors for receiving the flattened sealed end portion of the bulb while in electrical connection with the bulb terminals when the flattened sealed end portion of the bulb is inserted into the second end of the socket.

2. The connector assembly of claim 1, wherein the first end portion of the adaptor plug is rectangular in geometry.

3. The connector assembly of claim 1 further including means for positively latching the adaptor plug within the socket.

4. The connector assembly of claim 3 further including abutment means for limiting the depth to which the adaptor plug will slide into the socket.

5. The connector assembly of claim 4, wherein the first end of the adaptor's plug is non-circular and wherein the cavity in the socket for receiving the plug is non-circular wherein the first end of the adaptor plug is only slidably receivable within the socket.

6. The connector assembly of claim 5, wherein the contacts within the adaptor plug have female connectors formed of spring arms having flared end portions.

7. The connector assembly of claim 6, wherein the recess within the socket has a bottom surface and wherein the end of the adaptor plug is in spaced relation with the bottom surface of the recess when the adaptor plug is latched within the socket.

8. The connector assembly of claim 7, wherein the contacts within the socket and within the adaptor plug are separated by walls of insulating material.

9. The connector assembly of claim 3, wherein the latching means comprises a lug extending laterally from the first end portion of the adaptor plug, the lug being received within an opening of a spring latch arm on the socket.

10. The connector assembly of claim 9, wherein the adaptor plug has a hollow interior partially divided into two sections by an insulating wall wherein one of the contacts is on one side of the wall and the other contact is on the other side of the wall.

11. The connector assembly of claim 10, wherein the wall is disposed only between the female contacts which receive the blades of the contacts within the socket.

12. The connector assembly of claim 3, wherein each contact within the adaptor plug has female end connectors defined by opposed pairs of spring arms, each of which have electrical contacting portions and flared ends outboard of the electrical contacting portions.

13. The the connector assembly of 12, wherein proximate each contact within the adaptor plug there are provided shoulders extending inwardly wherein each contact has disposed intermediate the female connectors thereof, tangs which cooperate with the shoulders to retain the contacts within the adaptor plug enabling the contacts within the adaptor plugs to be initially slid into position.

* * * * *